US009243408B2

(12) United States Patent
Nicholson

(10) Patent No.: US 9,243,408 B2
(45) Date of Patent: Jan. 26, 2016

(54) ROOF ELEMENT

(76) Inventor: Joseph Robert Nicholson, Monkton (CA)

( * ) Notice: Subject to any disclaimer, the term of this patent is extended or adjusted under 35 U.S.C. 154(b) by 0 days.

(21) Appl. No.: 14/238,793

(22) PCT Filed: Aug. 16, 2012

(86) PCT No.: PCT/CA2012/000776

§ 371 (c)(1),
(2), (4) Date: Feb. 13, 2014

(87) PCT Pub. No.: WO2013/023284

PCT Pub. Date: Feb. 21, 2013

(65) Prior Publication Data

US 2014/0190104 A1 Jul. 10, 2014

(30) Foreign Application Priority Data

Aug. 16, 2011 (CA) ..... 2749455

(51) Int. Cl.

| | |
|---|---|
| ***E04D 1/30*** | (2006.01) |
| ***E04D 1/26*** | (2006.01) |
| ***E04D 1/18*** | (2006.01) |
| ***E04D 3/30*** | (2006.01) |
| ***E04B 7/02*** | (2006.01) |
| ***E04D 13/00*** | (2006.01) |

(52) U.S. Cl.

CPC . *E04D 1/265* (2013.01); *E04B 7/02* (2013.01); *E04D 1/18* (2013.01); *E04D 3/30* (2013.01); *E04D 13/00* (2013.01); *Y10T 428/24355* (2015.01)

(58) Field of Classification Search

CPC ..... E04D 1/30; E04D 13/00; E04D 1/18; Y10T 428/24355

USPC ..... 52/302.1, 518, 519, 520

See application file for complete search history.

(56) References Cited

U.S. PATENT DOCUMENTS

| | | | | |
|---|---|---|---|---|
| 3,269,075 | A * | 8/1966 | Cosden et al. | 52/522 |
| 3,579,940 | A * | 5/1971 | Greenleaf | 52/542 |
| 3,667,184 | A * | 6/1972 | Merrill et al. | 52/530 |
| 3,862,532 | A * | 1/1975 | Markos | 52/521 |
| 4,015,391 | A * | 4/1977 | Epstein et al. | 52/520 |
| 4,218,857 | A * | 8/1980 | Vallee | 52/94 |
| 4,271,652 | A * | 6/1981 | Svensson | 52/478 |
| 4,343,126 | A * | 8/1982 | Hoofe, III | 52/313 |
| 5,495,654 | A * | 3/1996 | Goodhart et al. | 29/527.4 |

(Continued)

*Primary Examiner* — Brian Glessner
*Assistant Examiner* — Paola Agudelo
(74) *Attorney, Agent, or Firm* — Kenneth L. Bousfield; Bereskin & Parr LLP/S.E.N.C.R.L.,s.r.l.

(57) ABSTRACT

A roofing element for mounting on a sloped roof includes a formed panel. In one embodiment the length is at least as great as the width, the width being cross-wise relative, the length running down the slope. The formed panel has a relief pattern that has a grain direction aligned with the length. The width may be less than one arm's length. The relief element simulates a wooden shake or a slate tile. The sheet metal panel has top, bottom, and first and second side edge margins, The top edge margin has a bulge at one end, and a matingly sized double cuff at the other end. The next adjacent side has a relieved upper end flange that has a transition from a flat flange to a narrower upstanding curved wall defining the lower edge of an accommodation permitting the double cuff of one panel to seat in the mating accommodation of the next adjacent panel. When installed, the accommodation and the double cuff are overlain by the bottom edge margin flange of the next up-slope tile.

22 Claims, 14 Drawing Sheets

(56) References Cited

U.S. PATENT DOCUMENTS

| | | | | |
|---|---|---|---|---|
| 5,613,337 | A * | 3/1997 | Plath et al. | 52/533 |
| 5,953,810 | A * | 9/1999 | Goodhart et al. | 29/557 |
| 6,173,546 | B1 * | 1/2001 | Schafer | 52/522 |
| RE38,210 | E * | 8/2003 | Plath et al. | 52/533 |
| 6,619,006 | B1 * | 9/2003 | Shirota | 52/520 |
| 7,331,150 | B2 * | 2/2008 | Martinique | 52/520 |
| 2005/0257477 | A1 * | 11/2005 | Beetler et al. | 52/553 |
| 2006/0130419 | A1 * | 6/2006 | Bowman | 52/560 |

* cited by examiner

DETAIL Top Edge

DETAIL Bottom Edge

ROOF ELEMENT

FIELD OF THE INVENTION

This invention relates to roofing materials, and in particular to roofing elements such as may form the surface of the roof exposed to the weather.

BACKGROUND OF THE INVENTION

In North America asphalt shingles are used as the surface elements of many inclined roofs. However other materials are known, such as wooden shakes, such as cedar shakes; clay tiles; and metal roofing panels. In agricultural or industrial applications, relatively long, corrugated metal sheets of constant section, or hat sections have been long known. However, metal or plastic roofing tiles may also be provided in smaller sections, those sections having a stamped contour or texture. The stamped texture may be intended to simulate the pattern of, for example, asphalt shingles. Alternatively, they may have a pattern resembling slates or tiles. In a further alternative, they may have the general appearance of wooden shakes, such as cedar shakes.

Another common problem with metal shingles is the issue of the double overlap at one corner. That is, in the installation of metal tiles, not only does the row next above overlap the upper margin of the next lower row, but, in addition, one or other of the next adjacent plates to the left or right also over laps laterally, such that the nailing tab on that side is hidden. The adjacent plates may also have interlocking ridges along their edges to discourage entry of water. There is a tendency at the upper corner of the under-lapping plate for the wind to drive water into the joint, and thus under the adjacent plate. Over time a build up of moisture may occur. This build up of moisture may be more than the underlayment may be suitable for handling.

SUMMARY OF THE INVENTION

In an aspect of the invention there is a roofing element for mounting on a sloped roof, the roof having a slope-wise direction, a cross-wise direction transverse to the slope-wise direction, and an upstanding direction normal to the sloped roof. The roofing element has a formed sheet metal panel having a cross-slope width and a slope-wise length. The sheet metal panel has a top edge margin, a bottom edge margin, a first side edge margin, and a second side edge margin, the top edge margin being for installation up-slope of the bottom edge margin when mounted to the sloped roof. The top edge margin has an upwardly formed over-folded flange with a distal flange edge oriented down-slope. The bottom edge has a downwardly formed under-folded flange with a distal flange edge oriented up-slope. The bottom edge has a down-slope margin defining a drip line, as installed in use the drip line lying down slope of a mating top edge margin of a next lower adjacent roofing element. The first side edge margin has an upwardly bent over-folded first side flange. The second side edge margin has a downwardly bent under-folded second side flange. The top edge margin and the first side edge margin meet at a first corner. The top edge margin and the second side edge margin meet at a second corner. The top edge margin has a first top edge corner portion at the first corner. The top edge margin has a second top edge corner portion at the second corner. The first side edge margin has a first top corner portion at the first corner. The second side edge margin has a second top corner portion at the second corner. The first top edge corner portion has an enlarged accommodation formed therein. The second top edge corner portion has a cuff fitting formed thereat. The cuff fitting is sized to mate, on installation, with a corresponding enlarged accommodation of a next laterally adjacent roofing element, the corresponding enlarged accommodation being the same as the enlarged accommodation of the first top edge corner portion.

In another feature of that aspect of the invention, the cuff fitting includes a double folded cuff. In another feature the double folded cuff includes an outer cuff and an inner cuff nested within the outer cuff, as oriented on installation, the outer cuff opens toward the next laterally adjacent roofing member. In a further feature the double folded cuff is of a size to fit in an interference fit in the enlarged accommodation.

In still another feature the double folded cuff includes an outer cuff and an inner cuff nested within the outer cuff, and the outer cuff has a margin extending laterally beyond the inner cuff. In yet another feature the outer cuff is flared. In still yet another feature the first top corner portion of the first side edge margin is formed to cooperate with the top edge of the top edge margin to define a narrowing end portion that, when installed lies concealed beneath the top edge corner portion of the top edge margin of the next laterally adjacent roofing member. In another feature wherein the narrowing portion has an upstanding closed end. In another feature the first side edge margin first corner portion includes an upstanding flange formed on a curve toward the first top corner, the curve having an increasing downslope angle tangent in a direction along the curve away from the corner.

In another feature the cuff fitting includes a double folded cuff; the double folded cuff includes an outer cuff and an inner cuff nested within the outer cuff, as oriented on installation, the outer cuff opening toward the next laterally adjacent roofing member; the outer cuff has a margin extending laterally beyond the inner cuff; the first top corner portion of the first side edge margin is formed to cooperate with the first top edge corner portion of the top edge margin to define a narrowing end portion that, when installed lies concealed beneath the second top edge corner portion of the top edge margin of the next laterally adjacent roofing member; and the narrowing portion has an upstanding closed end.

In another aspect of the invention there is a roofing element for mounting on a sloped roof. It has a formed panel having a cross-slope width and a slope-wise length. The length is at least as great as the width. The width is for orientation cross-wise relative to the roof, the length is for orientation in the direction of the slope of the roof. The formed panel has a relief pattern formed therein. The relief pattern has a grain direction. The grain direction is predominantly aligned with the length. The width is less than one arm's length.

In another feature of either aspect of the invention, the roofing element has at least one relief feature, or element, formed therein simulating one of (a) a wooden shake; and (b) a slate tile. In a further feature, the roofing element has a plurality of relief features formed therein simulating one of (a) a plurality of wooden shakes; and (b) a plurality of slate tiles. In a further feature the roofing element has a first margin and a second margin. The first margin is an up-slope margin. The second margin is a down-slope margin. The first margin has a fastener securement portion for concealment under a next adjacent up-slope roofing element upon installation on a roof. The roofing element has a first relief feature formed therein. The first relief feature has a first surface portion and a second surface portion. The first and second surface portions meet along a common vertex. The first surface portion is closer to the fastener securement portion than the second surface portion. The first surface portion defines a flank surface of the relief feature. The flank surface has a gentle overall rise-over-run in the length direction. The second surface portion defines an end face surface of the relief feature, the end face surface portion having a steep rise-over-run in the length direction.

In another feature the roofing element has a second relief feature formed therein, the second relief feature having a first surface portion and a second surface portion, the first and second surface portions of the second relief feature meeting along a common vertex, the first surface portion is closer to the fastener securement than the second surface portion. The first surface portion defines a flank surface of the relief feature, the flank surface having a gentle overall rise-over-run in the length direction. The second surface portion defines an end face surface of the relief feature, the end face surface portion having a steep rise-over-run in the length direction. The second relief feature is located more distantly from the up-slope margin than is the first relief feature. In an additional feature, either (a) the flank surface has a longitudinally grooved texture simulating a wood grain, and the end face surface simulated a wood end grain; or (b) the flank surface has a stone tile simulating surface.

In another feature, the roofing element has first and second side margins, and first and second end margins. The first and second side margins run in the lengthwise direction. The first and second end margins run in the cross-wise direction. The first and second side margins and first and second end margins co-operate to define a rectangular footprint extending in a plane. The first end margin has a first fastening region. The first side margin has a second fastening region. The second end margin has a skirt for placement overlapping a lengthwise next adjacent roofing element. The second side margin includes a skirt for placement overlapping a cross-wise next adjacent roofing element.

In yet another feature, the first end margin is an up-slope margin. The second end margin is a down-slope margin. The first end margin has a fastener securement portion for concealment under a next adjacent up-slope roofing element upon installation on a roof. The roofing element has a first relief feature formed therein. The first relief feature has a first surface portion and a second surface portion. The first and second surface portions meeting along a common vertex, the first surface portion is closer to the fastener securement than the second surface portion. The first surface portion defines a flank surface of the relief feature, the flank surface having a gentle overall rise-over-run in the length direction. The second surface portion defines an end face surface of the relief feature, the end face surface portion having a steep rise-over-run in the length direction.

BRIEF DESCRIPTION OF THE DRAWINGS

These and other aspects and features of the invention may be more readily understood with the aid of the illustrative Figures included herein below, showing of an example, or examples, embodying the various aspects of the invention, provided by way of illustration, but not of limitation of the present invention, and in which.

DETAILED DESCRIPTION

Figure 1A:
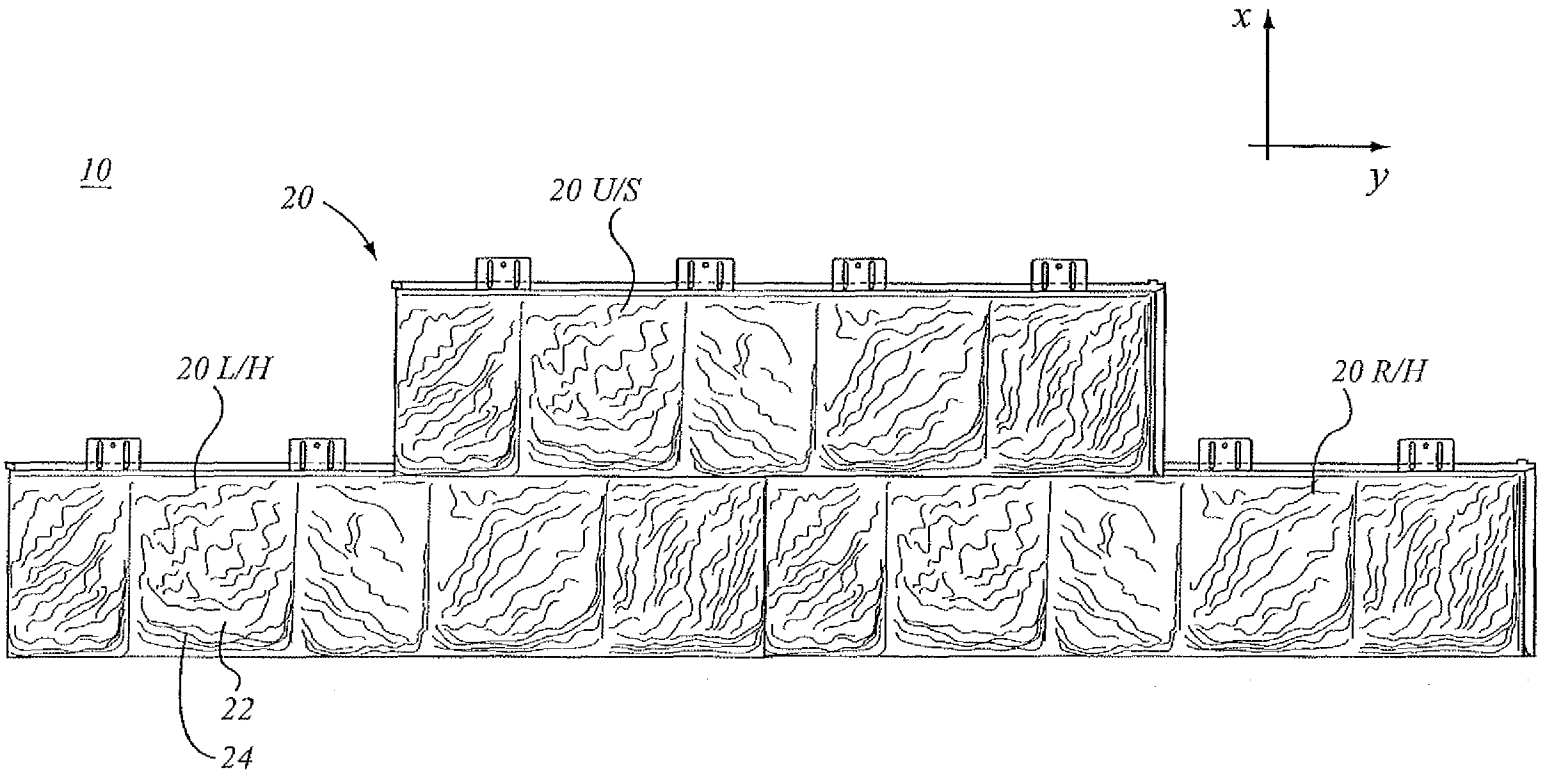
FIG. 1*a* is a plan view of a portion of a roof having an array of formed plates according to an aspect of the invention.
Figure 1B:
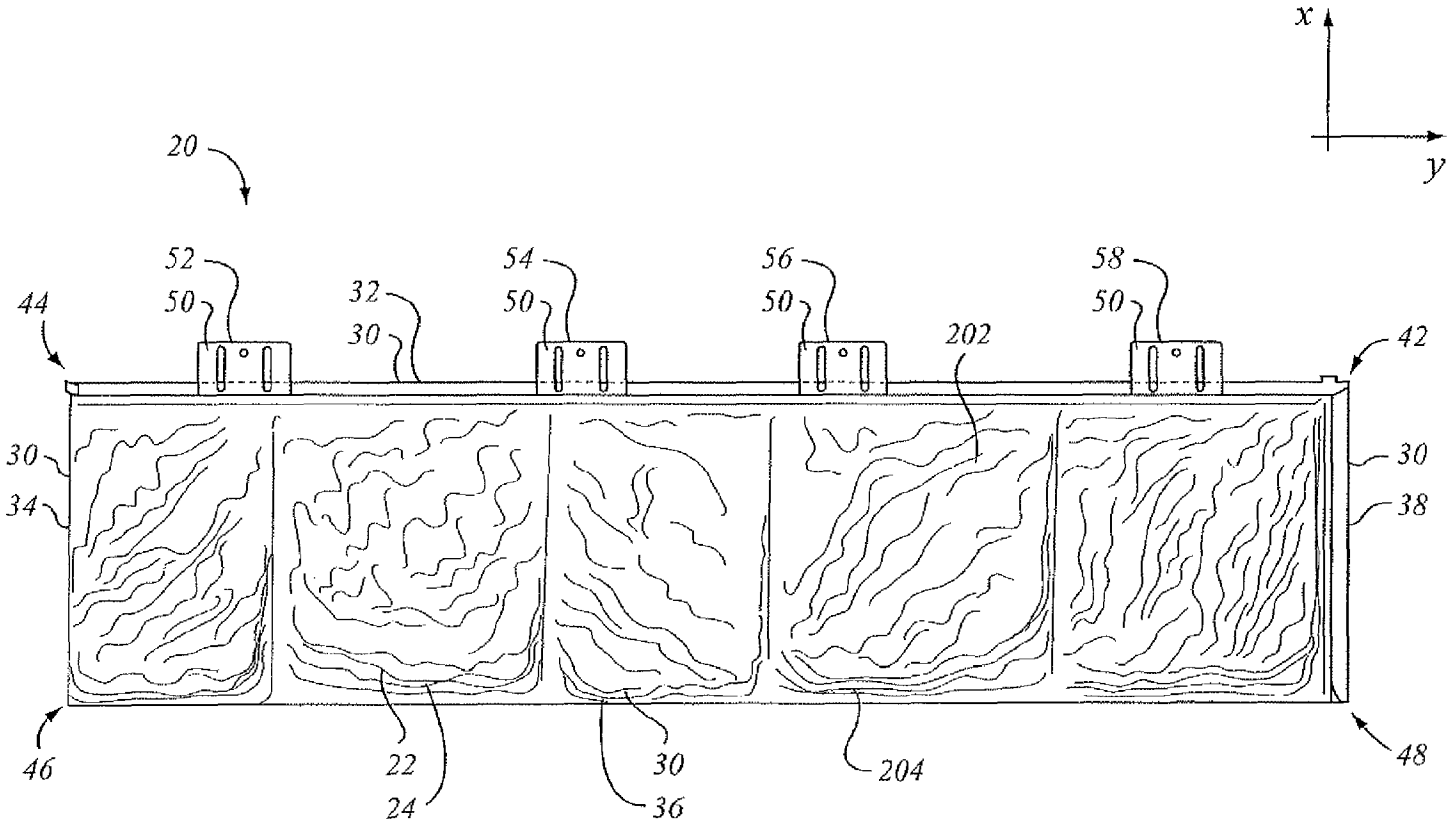
FIG. 1*b* is a plan view of a single contoured-surface roof tile of the array of FIG. 1*a;*

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are generally in proportion, though perhaps not precisely to scale, and may be taken as being roughly to scale except where noted otherwise, such as in those instances in which proportions may have been exaggerated in order more clearly to depict certain features of the invention.

Following from *Phillips* v. *AWH Corp.*, definitions provided in the specification are intended to supplant any dictionary definition, and to prevent interpretation in the US Patent Office (or in any other Patent Office) that strays from the customary and ordinary meaning of the terms provided herein. The claims are to be interpreted in a manner consistent with their use in context herein. The detailed description that follows is to be understood to include synonyms of the terms used.

To commence, FIG. 1*a* is a general arrangement view of a portion of a roof 10 to which an array of roofing members 20, which may be referred to as plates or shingles or tiles have been applied. In this description it may help to define a Cartesian frame of reference in which the plane of roof 10 to which roofing members 20 are applied is the reference datum. Roof 10 is inclined on a slope at some angle. While the angle may be as little as 3/12, 4/12 or 5/12, in some cases it may be rather much steeper, be it 10/12 or 12/12. (In this terminology, thought to be common in the industry in North America, the numerator is the rise, in feet, and the denominator is the run, in feet). For the purposes of this discussion the up-slope direction may be considered the positive x-direction, or x-axis, and, conversely, the negative direction is down-slope. The y-direction or y-axis runs across the slope perpendicular to the x-direction, and the z-axis, or z-direction runs perpendicular to the slope. To the extent used herein, "proud", "shy", and "flush" have their plain and ordinary engineering meanings, "proud" referring to something that extends beyond adjacent structure, "shy" referring to something that lies a bit short of adjacent structure, and "flush" being something roughly continuous with adjacent structure, the three terms corresponding conceptually to "greater than", "less than", and "equal to".

Roofing members 20 may be intended to simulate asphalt shingles, in which case they may be are substantially flat. However, roofing members 20 may alternately be intended to simulate either (a) wooden shakes; or (b) slates, or possibly some other style of roofing tile, perhaps such as terra cotta tiles. In those forms of roofing, whether shakes or slates, the shake or the slate has a substantial through-thickness in the z-direction. When traditional shakes or slate are installed, the lower edge of each shake or slate overlaps the next lower shake or slate, such that the surface of each shake or slate element is at a slope that is somewhat less steep relative to the ground than is the datum slope of the underlying roof, that apparent difference in angle having a tangent defined by the through-thickness divided by the slate length. As may be understood, roofing members 20 are metal members, notably sheet metal members with patterned indentations defining simulacra of traditional asphalt, stone or wood shingles. These may, typically, be sheet metal stampings with formed edges that have been bent to give a desired fold or shape. For a metal shingle to have substantially the same appearance, or a reasonably similar appearance, the contour impressed in the drawn steel sheet may then be rather shallower at the up-slope end, and deeper at the down-slope end. Thus each tile may have a characteristic "up-slope" and "down-slope" direction. With simulated cedar shakes this may be even more apparent given that the impressed form may have a simulated "grain" or grain-direction running in the up-slope and down-slope direction. In the terminology used herein, the top or top edge of the plate, or panel, or shingle is the up-slope edge, and the bottom or bottom edge is the down-slope edge. Although it is entirely arbitrary, when the description refers to the left hand side or edge, or the right hand side or edge, it is as seen looking orthogonally toward the roof from outside.

Roofing member 20 includes a main panel portion 22 into which a contoured profile 24 has been pressed or stamped or moulded, or drawn, as may be. In one embodiment that profile (and such paints, tints, or other colouring as may be suitable) has the form of a stone e.g., slate, roof tile or tiles as at 26. In another embodiment contoured profile 24 may have the form of wood grain, such as cedar shakes, shown at 28. In the rest of the illustrations contoured profile 24 is not shown for the purposes of clarity. However, in each case member 20 may be understood to have such a profile. Alternatively, in some embodiments the surface of the plate may be either substantially flat, or corrugated with the corrugations running in the up-slope-down-slope direction such as not to impede the draining of moisture.

The periphery of roofing member 20 includes margins 30 identified as a top edge 32, a left hand edge 34, a bottom edge 36 and a right hand edge 38. Top edge 32 and right hand edge 38 meet at a first corner, identified as top right corner 42. Left hand edge 34 and top edge 32 meet at a second corner, identified as top left corner 44. Bottom edge 36 and left hand edge 34 meet at a third corner, identified as bottom left hand corner 46. Right hand edge 38 and bottom edge 36 meet at a fourth corner, identified as bottom right hand corner 48. These corners are shown, respectively, in FIGS. 4*a*, 3*a*, 5*a* and 6, and will be described in turn below. It may also be noted that the first, or upper, or top edge 32, has securement fittings 50 mounted thereto, securement fittings 50 having the form of stamped sheet metal cleats 52, 54, 56, 58 spaced therealong, each cleat having stiffening dimples and an eye through which to insert a threaded fastener or nail. Typically member 20 rests atop a sheet of roofing underlay, which itself lies upon roof sheathing laid over roof rafters or trusses. The fastener is driven through the underlayment and into the roof sheathing, typically plywood, to secure member 20 in place.

Considering first top edge 32, main panel portion 22 includes a web 60 into which the desired sheet profile, if any, is stamped or otherwise formed. At the margin, the metal sheet stock 62 of which roofing member 20 is formed is folded upward and back over on itself to define a first folded edge member, 64. Member 64 has a back, or curved part, 66, and a return folded member which may be identified as a flange 68. In some embodiments flange 68, or the major portion thereof running along the upper margin of main panel portion 22 is not in a parallel planar relationship to web 60 (or the portion of which flange 68 overlies), but rather is oriented on an angle, or splay such that flange 68 diverges from web 60 in the down-slope direction. Flange 68, being spaced away from main panel portion 22, defines a first grip or catch, or hook, or finger, or hold, there being an accommodation 70 into which a mating member, i.e., a mating grip, catch, hook, finger, hold, etc., of the bottom edge of the next more up-slope roofing member 20 can be engaged. To the extent that the securement fittings have been screwed down to the roof sheathing, when so engaged the next upper roofing member 20 is captured and secured to the roof by this mutual engagement.

The middle or main portion 72 of first folded edge member 64, including flange 68, is of constant section and orientation over its length, that length being more than ⅘ of the overall length of top edge 32. Cleats 52, 54, 56 and 58 are mounted to main portion 72 of flange 70 with appropriate spacing as indicated. Main portion 72 lies between a right hand corner portion 74 and a left hand corner portion 76. The very distal tip of flange 68 is identified as edge 78.

Along left hand edge 34 web 60 also has a second formed, or folded, edge member 80, which may generically be termed a flange, this flange being folded downwardly, or underneath, web 60, rather than folded upwardly. Along the major, or central portion 82 of member 80, member 80 has a back, or curved part 84 and a downwardly and inwardly extending wing or leg, or flange, 86. The distal edge of flange 86 is folded back over itself in a rounded lip 88. Central portion 82 is of constant, or substantially constant, section, and extends along the great majority of left hand edge 34, being more then ⅘ of the length of left hand edge 34. Flange 86 may not necessarily lie in a plane parallel to the plane of the edge of web 60, but may be angled thereto on a somewhat splayed angle such that an inwardly convergent, or narrowing, accommodation 90 is formed between flange 86 and web 60. Flange 86 thus defines a second grip or catch, or hook, or finger, or hold, by which accommodation 90 may provide a seat for a mating member, i.e., a mating grip, catch, hook, finger, hold, etc., of the right hand edge of the next laterally adjacent roofing member 20 can be engaged. To the extent that the securement fittings have been screwed down to the roof sheathing, the two laterally engaged roofing members are constrained to sit next to each other by this mutual engagement. Central portion 82 is bounded at top and bottom by left edge top portion 92 and bottom portion 94.

Along bottom edge 36 web 60 has a third folded edge member 100, which may be referred to generically as a catch, 102, this flange being downwardly rolled, or bent on a more generously sized radius of curvature on curved portion 104 than the curve portions previously described, and ending in a leg, or wing, or hook, or flange 106. When installed in mating condition with a next lower down-slope roofing member, curved portion 104 overlaps, conceals, and in some measure protects, the corresponding up-slope edge of that down-slope roofing member, the down-slope portion of the curve defining a drip line at which rain may drop from the up-slope plate onto the down slope plate. Flange 106 may be substantially parallel to the overall plane of web 60, or may be somewhat flared. The distal edge 108 of flange 106 may have a back, or inwardly, folded lip 110. Folded edge member 100 extends along substantially the entire length of bottom edge 36, and has a folded lateral edge lip at 112 in the left hand corner. The right hand portion 114 of folded edge member 100 is formed on a slightly smaller local radius, and is of slightly smaller size, such that it may fit closely nested within, for example, the corresponding bottom left hand corner 46 of the next adjacent roofing member 20 to the right hand side, ideally in an gently snug slight interference fit. Member 100 thus defines a third grip or catch, or hook, or finger, or hold, by which the accommodation 116 defined by the bight or crook of edge member 100, may provide a seat for a mating member, i.e., a mating grip, catch, hook, finger, hold, etc., of the top edge of the next adjacent down-slope roofing member 20 can be engaged. That is, upwardly bent flange 68 of the adjacent down-slope member 20 seats in accommodation 116, and upwardly curved flange 106 seats in accommodation 70 of adjacent down-slope member 20. It is expected that the smoothly rounded over-folded distal edge 108 may bottom in the crotch of rounded portion 66 before end 78 of flange 68 meets the back side of curved portion 104. The position of the next adjacent down-slope plate cannot be further down-slope than when the mating top and bottom bent edges bottom with respect to each other. As may be understood, the inwardly over folded lip of flange 114 presents a smoothly rounded edge, rather than a sharp edge, and, since it overlies the next adjacent down slope member, and since the down slope member has a re-entrant folded lip, rain water can flow off the up-slope member onto the down-slope member, and be carried down the roof from there. As engaged, folded edge member 100 cannot lift because the cleats of the adjacent member will not permit it.

Finally, along the fourth side, right hand edge 38, web 60 has a fourth folded edge member 120, which may be referred to generically as a catch, 122, this flange being upwardly formed, or bent, on curved portion 124, and ending in a leg, or wing, or hook, or flange 126. Flange 126 may be substantially parallel to the overall plane of web 60, or may be somewhat flared to yield a convergent space. Folded edge member 120 extends along substantially the entire length of right hand edge 38, except for the upper right hand corner portion, indicated generally as 128, the bottom right hand corner end being trimmed back on a rounded radius in the x-y plane as shown at 130. Upper right hand corner portion 128 is described below. Member 120 thus defines a fourth grip or catch, or hook, or finger, or hold, by which the accommodation 132 defined by the spaced opening between flange 126 and web 60 may provide a seat for a mating member, i.e., a mating grip, catch, hook, crook, finger, hold, etc., of the left edge of the next adjacent laterally to the right roofing member 20 can be engaged. That is, downwardly bent flange 80 (or 86) of the adjacent right hand member 20 seats in accommodation 132, and upwardly curved flange 126 seats in accommodation 90 of adjacent right hand member 20. As may be understood, the inwardly under-folded lip of flange 80 (or 88) presents a smoothly rounded edge, rather than a sharp edge, and, since it overlies the next laterally adjacent member, there is no path for water to reach the roofing underlay.

The corners of roofing panels of this nature have been problematic in the past. As may have been noted, along the four edges there are two under-folds (left hand edge 34, and bottom edge 36) and two over-folds (right hand edge 38 and top edge 32). The juncture of the two over-folds has in previous products tended to be the location most likely to leak water, particularly when driving rain is accompanied by high cross-winds.

Figure 4A:
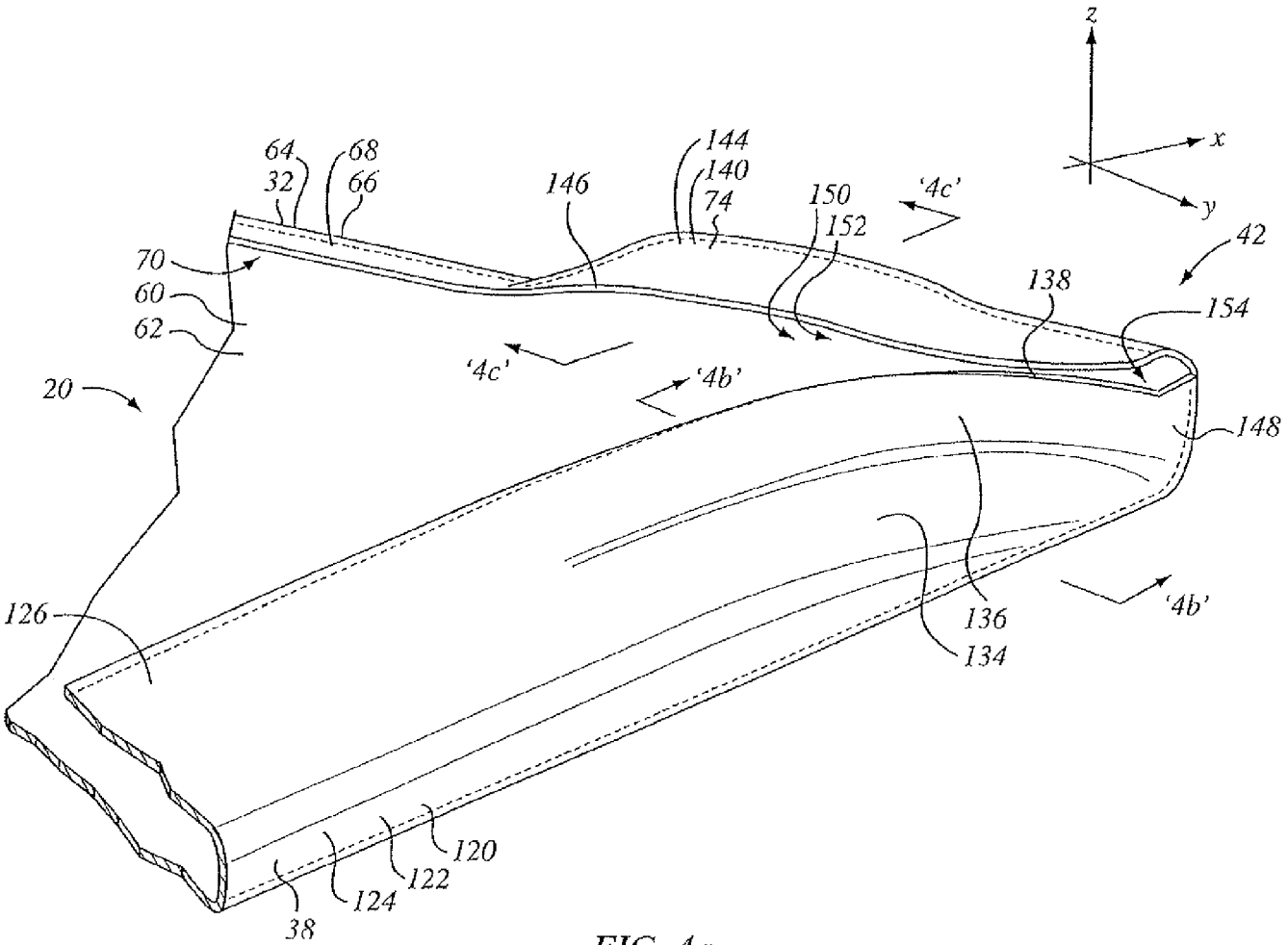
FIG. 4*a* is a perspective view of a top right corner detail of the roofing plate of FIG. 2*a;*
Figure 4B:
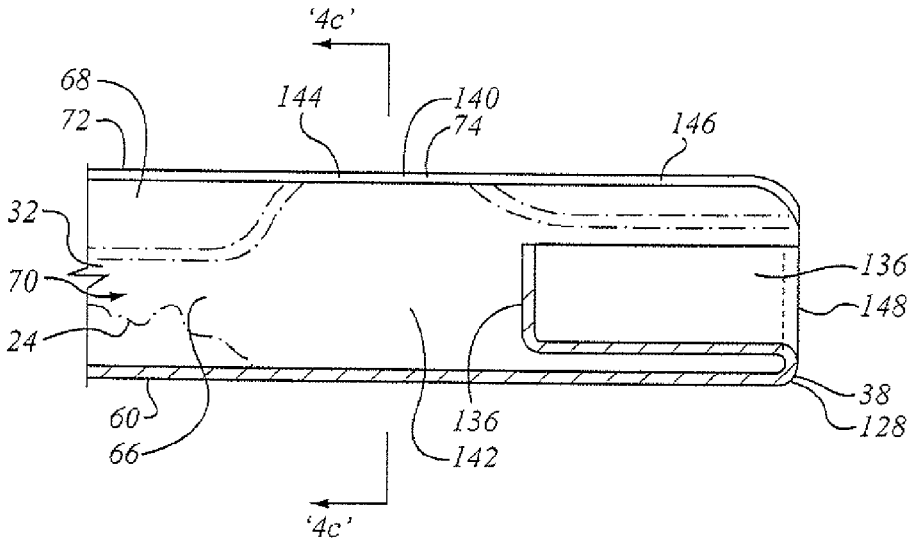
FIG. 4*b* is a sectional detail of the side edge of the top right corner detail of FIG. 4*a* taken on section '4*b*-4*b'*.
Figure 4C:
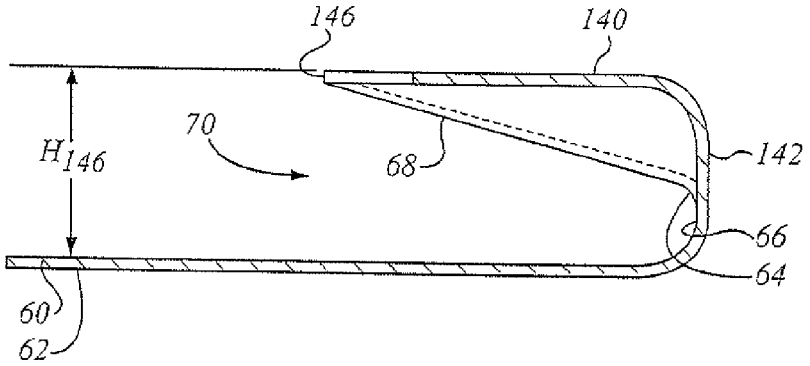
FIG. 4*c* is a sectional detail of the top edge of the top right corner detail of FIG. 4*a* taken on section '4*c*-4*c'*.

In examining top right corner 42, as shown in FIGS. 4*a*, 4*b* and 4*c*, the upper right hand corner portion 128 of fourth folded edge member 120 has been formed such that flange 126 transitions into a substantially flat leg 134 lying close to web 60, and a substantially upright leg 136 standing perpendicular to web 60. Curved portion 124 tapers to a correspondingly smaller radius toward top right hand corner 42. Through this transition leg 136 curves away to the right on curve 138, the effective length of flange 126 in the lateral direction becoming shorter as curve 38 approaches the corner.

First folded edge member 64 also has an end portion, namely right hand corner portion 74 at which flange 68 has a bulge 140, deviating away from web 60, with a deeper back 142, and a leg portion 144 that is more distant from web 60 than is the main portion of flange 68. The distal edge 146 of leg portion 144 and the distal edge of the main portion of flange 68 lie at the same z distance $H_{146}$ from web 60, such that they present a continuous line to the engaging edge of the next up-slope adjacent member 20. That is, the next up-slope member can be placed at different y-coordinate orientations relative to the down-slope tile, allowing different lateral left-right overlap as may be suitable to a particular roof. Leg 136, now fully upright, meets back 142 at a formed curved end 148.

The combined effect or the fold-and-curve of leg 136, and the bulge of back 140 and leg 142 is to create a space or vacancy, or accommodation, or pocket, indicated generally as 150, having a large entry portion 152, and a small tail portion 154 in the extreme corner. Large entry portion 152 extend to the left of (a) the laterally distal inwardly and upwardly folded laterally inwardly distal edge of flange 126, a distance roughly ½ to 1 times the length of flange 126. Formed curved end 148 closes the end of tail portion 154 in particular, and pocket 150 more generally as a closed wall or dam standing generally in the perpendicular or z-direction relative to the roof plane, and tending to inhibiting travel of water from pocket 150 rightward. The curve of leg 136 is such that gravity will tend to drain water away, either downwardly and to the left along the curve, or under flange 86 whence it can drain down the slope of the roof.

Figure 3A:
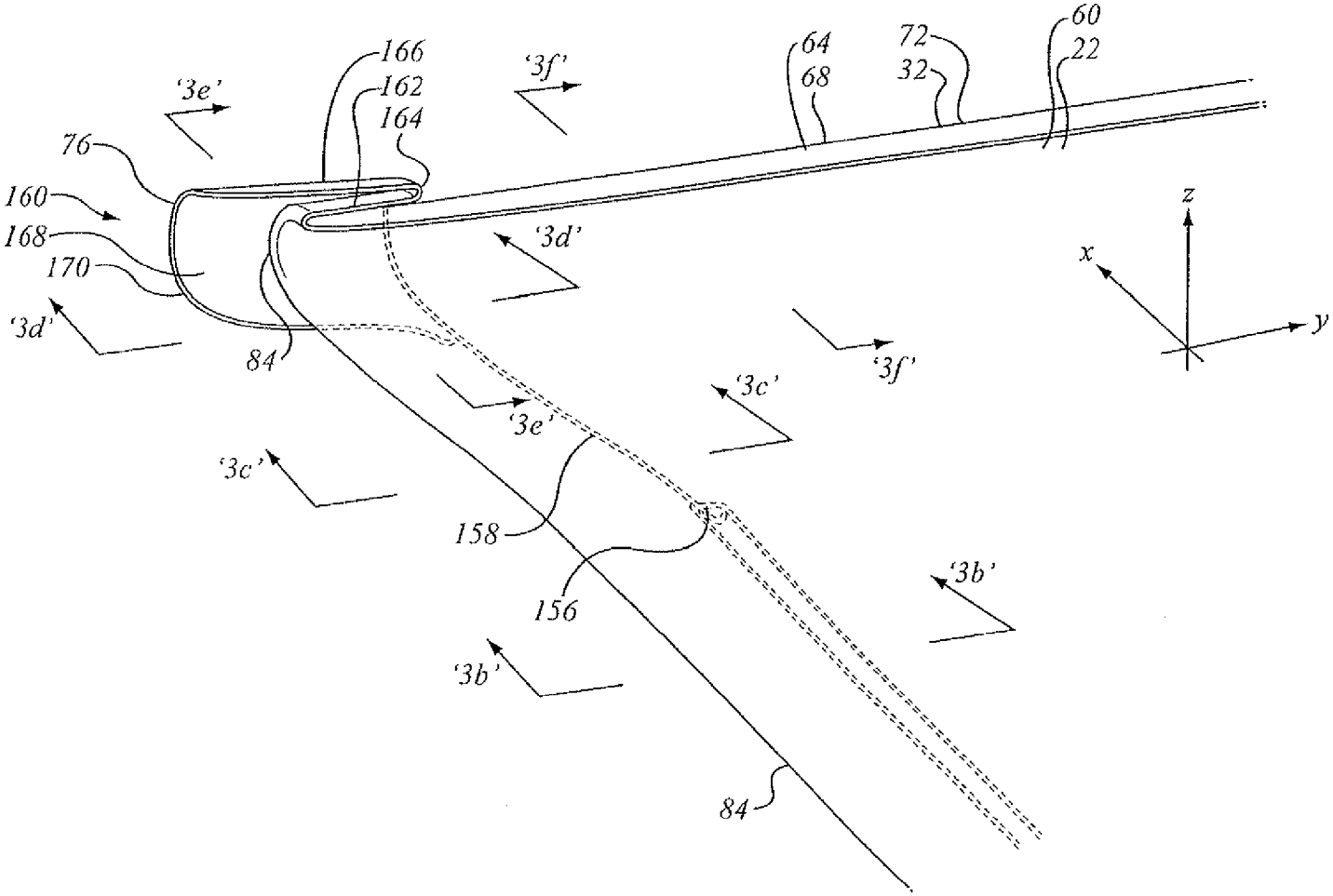
FIG. 3*a* is a perspective view of a top left corner detail of the roofing plate of FIG. 2*a;*
Figure 3B:
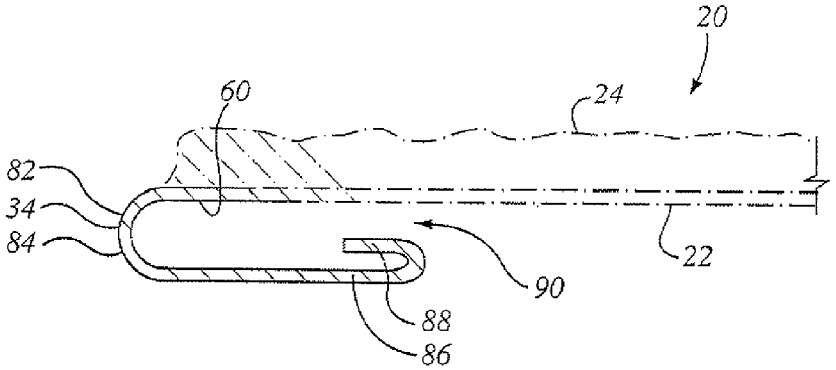
FIG. 3*b* is a sectional view of the top left corner detail of FIG. 3*a* taken on section '3*b*-3*b'*.
Figure 3C:
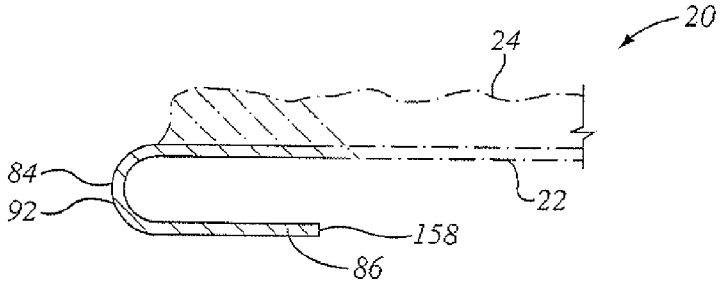
FIG. 3*c* is a sectional view of the left side edge of the top left corner detail of FIG. 3*a* taken on section '3*c*-3*c'*.
Figure 3D:
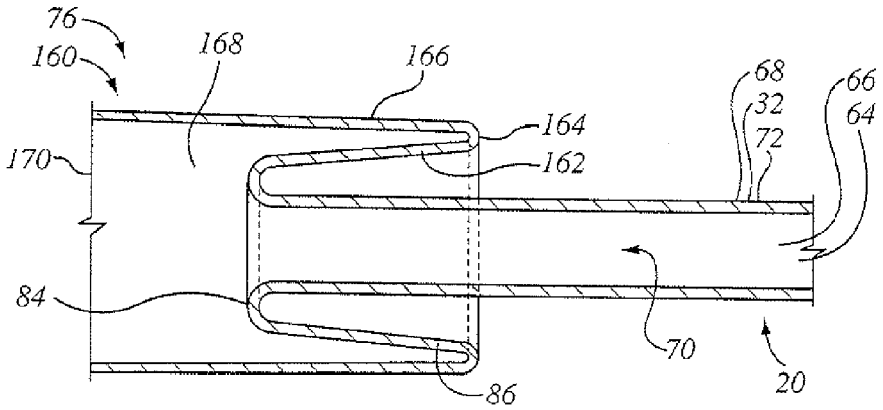
FIG. 3*d* is a sectional view of the left side edge of the top left corner detail of FIG. 3*a* taken on section '3*d*-3*d'*.
Figure 3E:
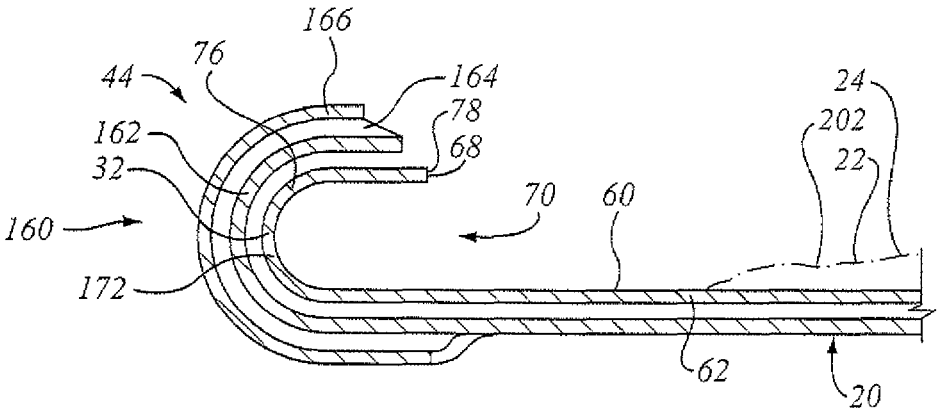
FIG. 3*e* is a sectional view of the top edge of the top left corner detail of FIG. 3*a* taken on section '3*e*-3*e'*.
Figure 3F:
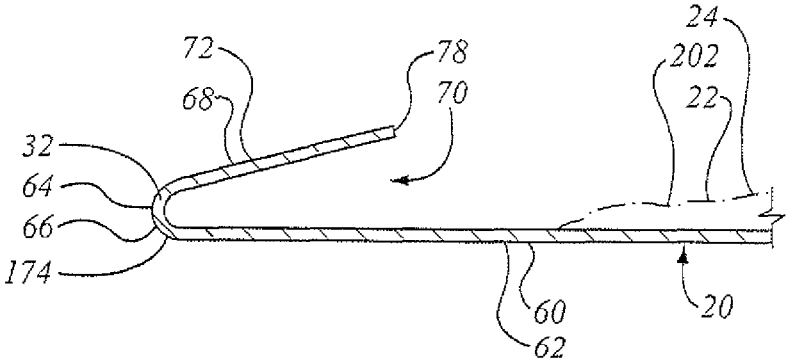
FIG. 3*f* is a sectional view of the top edge of the top left corner detail of FIG. 3*a* taken on section '3*f*-3*f'*.
Figure 3G:
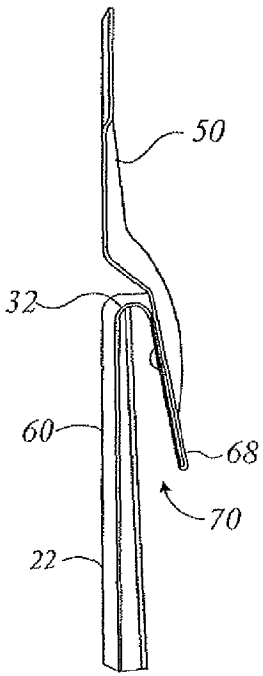
FIG. 3*g* is a sectional detail along the top edge of the plate of FIG. 2*a* showing the attachment tab in enlarged side view.
Figure 5C:
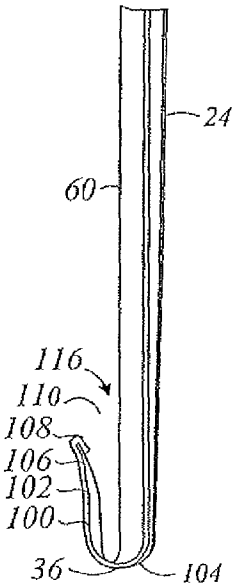
FIG. 5*c* is an enlarge detail of the roofing plate of FIG. 5*b;*
Figure 5B:
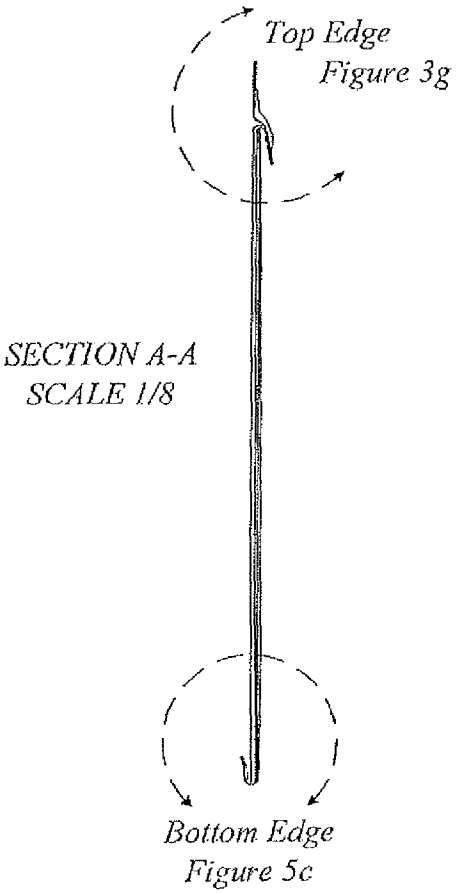
FIG. 5*b* shows a sectional view of the roofing plate of FIG. 2*a;*

Top left corner 44 has been formed in a shape that defines a double-folded cuff, indicated generally as 160. In this portion, left hand edge flange lip 88 (the rounded up or distal edge of flange 86) is discontinued at location 156, and the length of the leg of flange 86 diminishes in region 158 (shown in phantom lines). The top end portion 162 of flange 86 is formed to follow the curve around the top edge of the sheet where the laterally running top flange, 68, has its end portion, namely left hand corner portion 76. This folded back rolled over end portion 162 defines a first, or inner, skirt or cuff whose laterally outward edge is defined by the curved up portion of curved part 84 of edge member 80, and whose inward distal edge is defined by curved folded edge 164. A horn, or wing, or ear, or outer skirt or outer cuff, or second cuff, 166, of flange 86 is folded back on itself, and then formed in a conforming curve to that of shape end potion 162 (and 172, noted below). Second cuff 166 may have an extension, 168, that extends beyond, i.e., to the left of, curved part 84 of formed edge member 80. The outer wall, i.e., outer cuff 166, may parallel the inner wall, (i.e. inner cuff 162), or may flare slightly toward the open end at the distal edge (i.e., left-most edge as shown) of the cuff or skirt wall extension 168. The profile cut of the entire distal curved edge of extension 168 is smoothly rounded as shown at 170. It does not have sharp parts, or points. In portion 76, the curve bulges somewhat to a rounder shape 164 in FIG. 3*e* than that shown at 66 in FIG. 3*f* or FIG. 3*g*.

Figure 7:
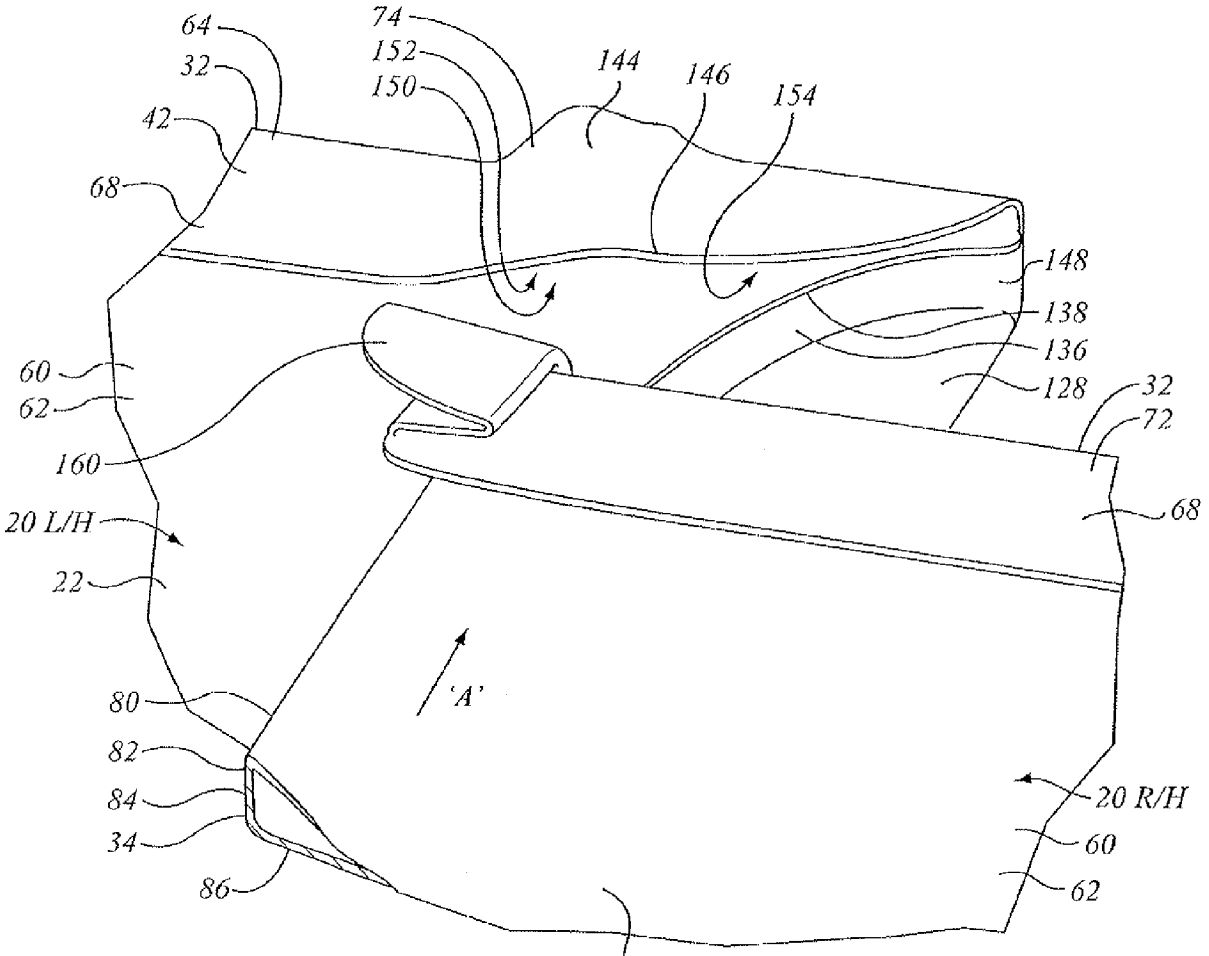
FIG. 7 is a perspective view of the top right corner of one roofing plate as shown in FIG. 2*a*, to a top left corner of an adjacent roofing plate as shown in FIG. 3*a* prior to final positioning along arrow 'A'.

As intended to be suggested by arrow 'A' in FIG. 7, on installation, the first and second side edges engage in a mating way, the one flange inside the other such that the left hand edge overlaps the right hand edge. The right-most travel of the rightward plate 20 R/H is defined by the position of the leftmost distal edge of the right edge flange of the leftward plate 20 L/H. This dictates the cross-wise position of double cuff 160 of the rightward panel 20 R/H relative to the receptacle, or accommodation defined by pocket 150. When moved in the direction of arrow 'A', the double cuff fits in large entry portion 152 of pocket 150, which may be an interference fit in which the cuff is in slight compression and the surrounding bulge has a slight tension pre-load. As may be noted, the distal edge of extension, 168, of the outer cuff 166 of double cuff 160, extending to distal edge 170, lies proud to the left of (i.e., transversely, or cross-wise leftward of) the folded back edge of left hand edge 34, to extend into the bulge of pocket 150. At the same time, as installed, curved edge 164 lies to the left of closed curved end 148. When installed, the entire double cuff 160 lies underneath, and within the contour of, the lower edge flange 106 of lower edge, or third folded edge member 100 of the next up-slope adjacent plate member 20 U/S (FIG. 1*a*). In this way the double folded cuff may tend to discourage the ingress of water at the juncture between the respective top right and left hand corners of adjacent 20 plates 20 L/H and 20 R/H. As such, double cuff 160 defines a bell, or trap. To the extent that water is driven therein by wind, and particularly if the bell is in a circumferential interference fit within the bulge, water driven into the trap is confronted by the closed end defined by folded edge 164. The path of drainage from this trap is, ultimately, down the slope of the leftward adjacent panel under flange 86. Any water than manages to get past this bell or trap and into tai; 154 is obstructed by the dam defined by curved end wall 148. The route of drainage is, again, down the leftward panel, under flange 86.

Figure 2A:
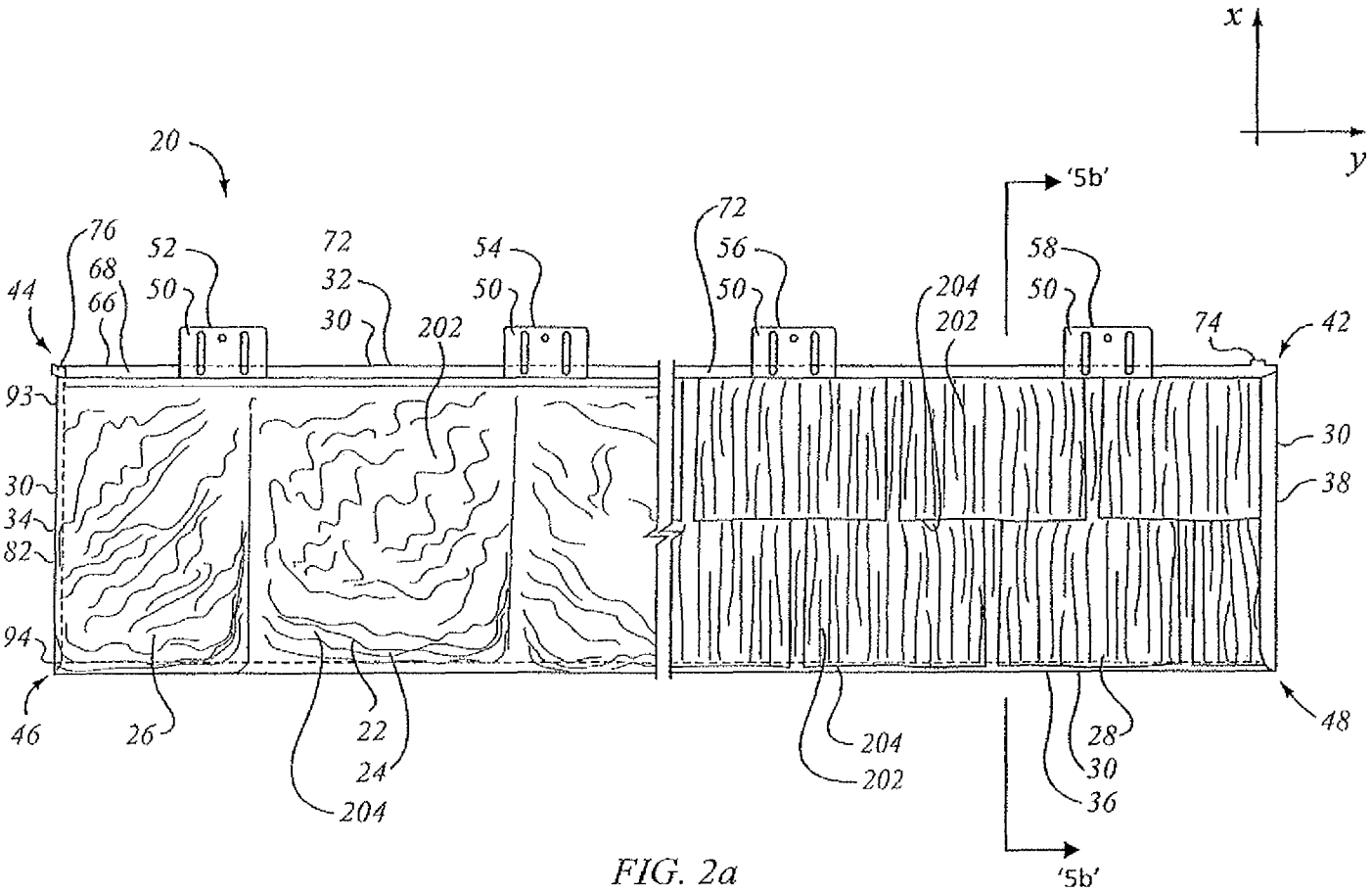
FIG. 2*a* is a plan view of a roofing plate according to an aspect of the present invention with alternate front contours shown in scab.
Figure 2B:
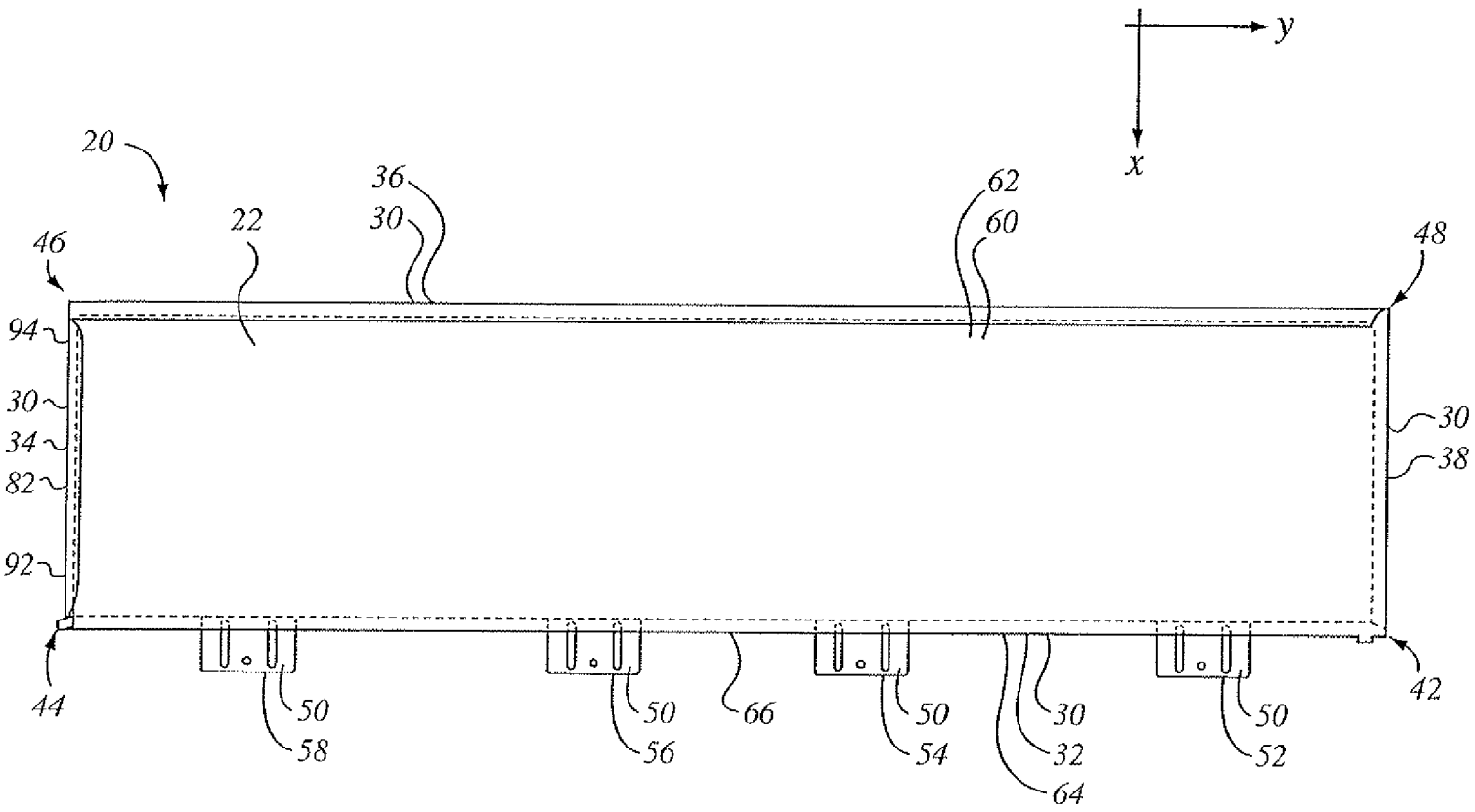
FIG. 2*b* is an underside view of the roofing plate of FIG. 2*a;*

In the embodiment of FIG. 2*a*, the breadth of member 20 in the y-direction, or lateral direction perpendicular to the slope of the roof, is greater than the height of member 20 in the x-direction running parallel to the roof slope. The use of tiles having a y:x aspect ratio of greater than 1:1, and typically on the order of 2:1-4:1 is not inconsistent with the known use of asphalt shingles that are relatively wide in the y-direction and thin in the x-direction.

The installation of these formed roofing tiles, or plates, or sections, is sometimes problematic, particularly if they are to be installed on a relatively steep roof. First, it is generally desirable to install roofing materials in an ascending manner, such that the next adjacent upper layer or row of shingles or shakes or tiles overlaps the next lower layer or row, such that water may tend to drain of the roof in the customary manner. For asphalt shingles, or shakes, installation usually involves the placement of successive ascending rows. After the first few rows are in place, it is acceptable to walk upon the shingles or shakes (on a shallow roof) or to lean a ladder against the shingles or shakes (on a steeper roof). With the elements of a metal-sheathed roof, it may be undesirable to do this, either because it may tend to damage the surface of the roof, or because the metal roofing may be relatively slippery, particularly if wet.

Figure 5A:
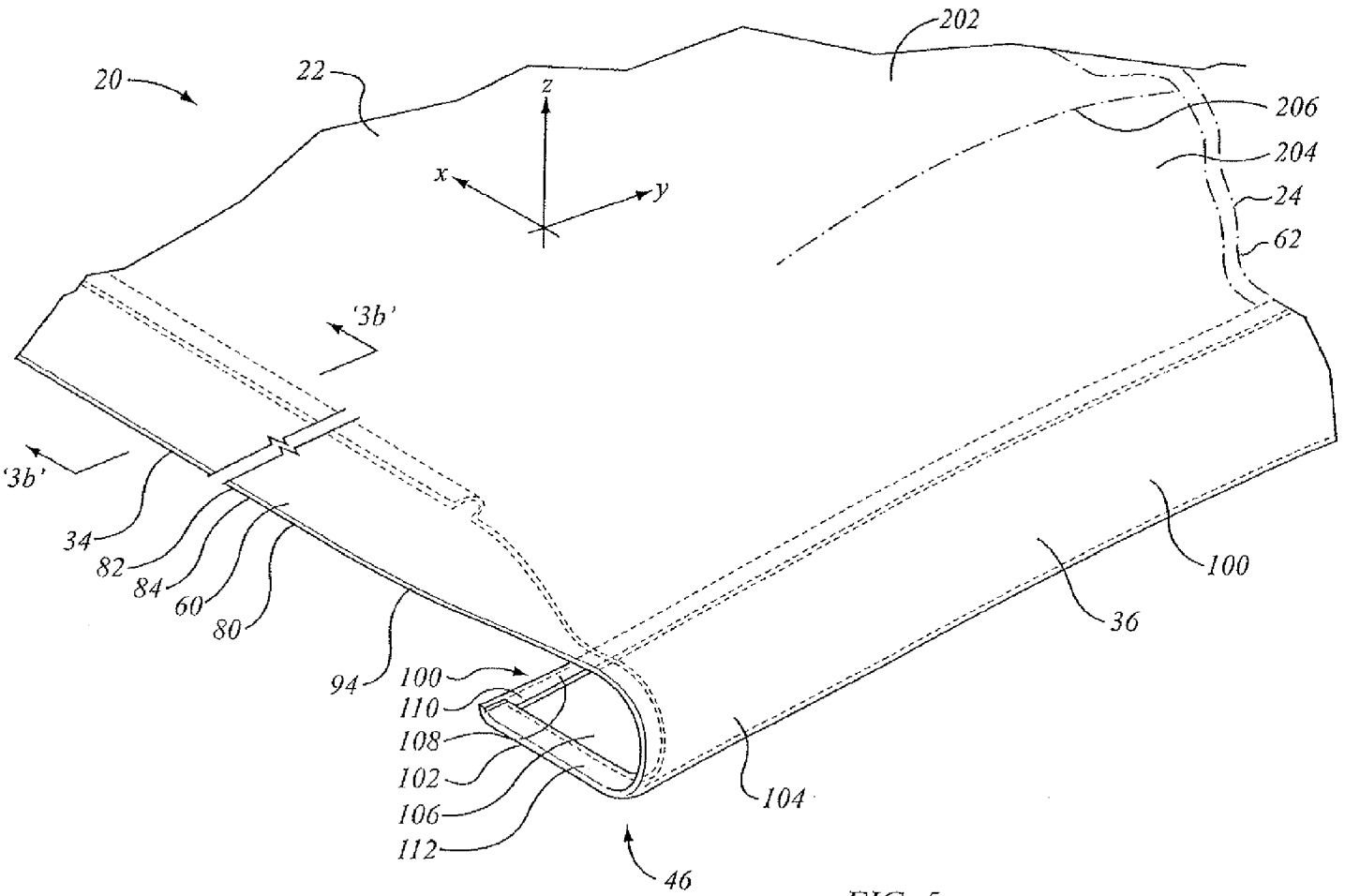
FIG. 5*a* is a perspective view of a bottom left corner detail of the roofing plate of FIG. 2*a;*
Figure 6:
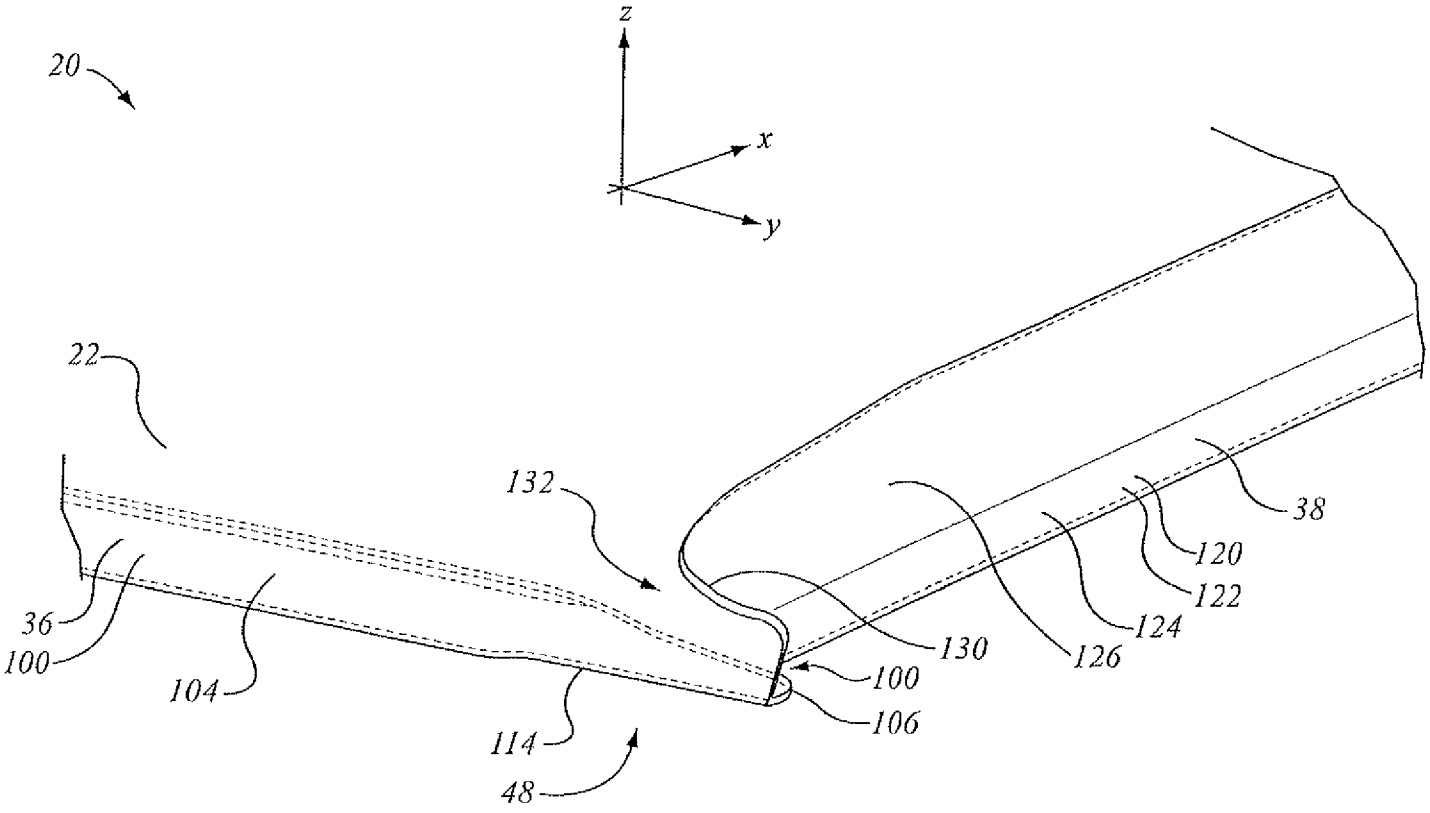
FIG. 6 is a perspective view of a bottom right corner detail of the roofing plate of FIG. 2*a;*
Figure 8B:
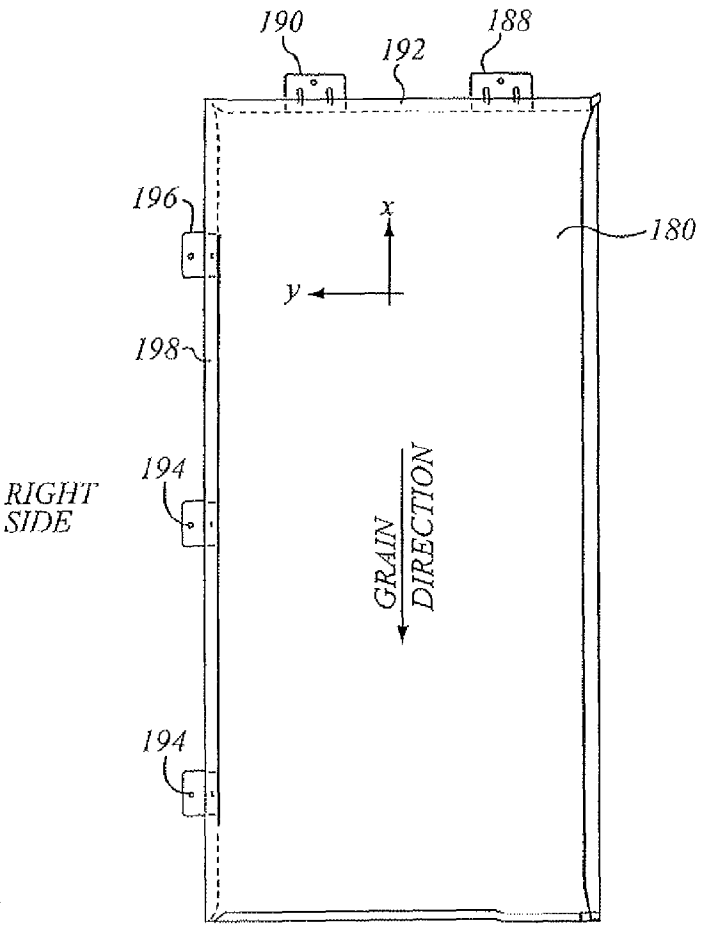
FIG. 8*b* shows a back view of the alternate embodiment of FIG. 8*a.*
Figure 8A:
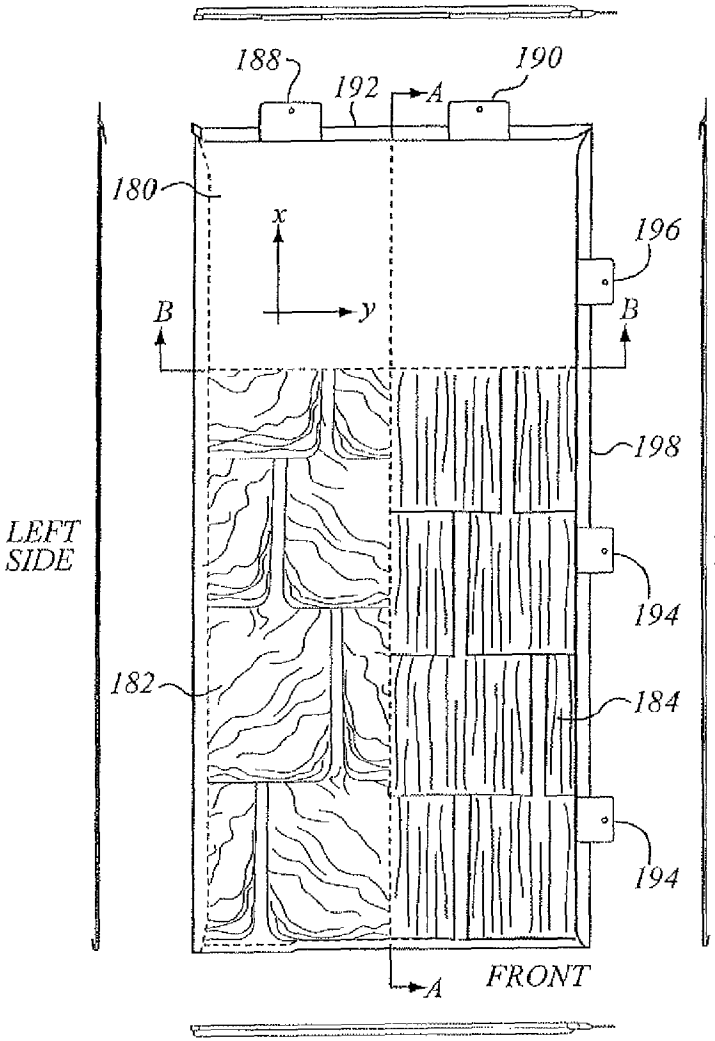
FIG. 8*a* shows a front plan view of an alternate embodiment of roof tile to that of FIG. 2*a*.

In those instances, such as where the roof is too steep for walking, it may be helpful to have roof tiles that have the aspect ratio reversed-namely the up-slope length in the x-direction is as great as, or greater than, the cross-slope width in they-direction. Such an embodiment is shown in FIGS. 5*a* and 8*b*, the tile being indicated generally as 180, such that the aspect ratio of x:y lies in the range of 1:1 to 4:1, and more narrowly in the range of 2:1 to 3:1 with the absolute value of the y dimension being less than what a worker may typically be able to reach at arm's length laterally while standing on a ladder, with the ladder resting against the uncovered roof sheathing. Such a lateral distance might be three feet or less, or perhaps 30 inches or less, and, in either case, may be more than 12 inches and most probably more than 18 inches in width. For the purpose of this description "arm's length" shall be defined as being substantially the same as one English yard, or thereabout, and may be taken as being roughly the same as, or slightly shy of, one meter in terms of the Metric system. The slope direction, is aligned with the contour of the slate images 182 or the grain of the cedar shake images 184 formed in main portion 186 of plate 180, the "grain direction" so defined being predominantly aligned with, or substantially parallel to, the x-direction arrow. In this instance plate 180 has cleats 188, 190 along the top or up-slope edge 192, and also cleats 194, 196 mounted on the right hand (i.e., upward folded) edge 198. In this embodiment the corner fittings, including the interlocking left and right hand upper edge corner fittings, are as described above in the context of member 20.

Looking at the relief features formed in the sheet metal to simulate the cedar shakes or slate members, roofing element 20 can be said to have a relief pattern formed therein. The relief pattern has a grain direction. The grain direction is predominantly aligned with the length.

The roofing element has at least one relief element formed therein simulating one of (a) a wooden shake 28; and (b) a slate tile 26. The roofing element typically has a plurality of such relief features formed therein. The first relief feature 24 has a first surface portion 202 and a second surface portion 204. The first and second surface portions meet along a common vertex. As can be seen, first surface portion 202 is closer to the top, or upper, edge fastener securements than second surface portion 204. First surface portion 202 defines a flank surface of relief portion or feature 24. The flank surface has a gentle overall rise-over-run in the downslope length direction when laid on a flat horizontal surface (or when taking the roof slope as the datum). Second surface portion 204 defines an end face surface of relief portion or feature 24, the end face surface portion having a steep rise-over-run in the up-slope length direction when laid on a flat horizontal surface (or when taking the roof slope as a datum). Roofing element 20 has a second relief feature 24 formed therein, the second relief feature similarly having a first surface portion 202 and a second surface portion 204, the first and second surface portions of the second relief feature meeting along a common vertex, the first surface portion being closer to the top edge fastener securement than is the second surface portion. The first surface portion 202 defines a flank surface of the second relief feature 24, the flank surface having a gentle overall rise-over-run in the length direction. The second surface portion 204 defines an end face surface of the relief feature 24, the end face surface portion having a steep rise-over-run in the length direction. The second surface portion 204 is located more distantly from the up-slope margin than is the first surface portion 202. In an additional feature, either (a) the flank surface has a longitudinally grooved texture simulating a wood grain, and the end face surface simulated a wood end grain; or (b) the flank surface has a stone tile simulating surface.

In another feature, the roofing element has first and second side margins, and first and second end margins. The first and second side margins run in the lengthwise direction. The first and second end margins run in the cross-wise direction. The first and second side margins and first and second end margins co-operate to define a rectangular footprint extending in a plane. The first end margin has a first fastening region. The first side margin has a second fastening region. The second end margin has a skirt for placement overlapping a lengthwise next adjacent roofing element. The second side margin includes a skirt for placement overlapping a cross-wise next adjacent roofing element. In yet another feature, the first end margin is an up-slope margin. The second margin is a down-slope margin. The first end margin has a fastener securement portion for concealment under a next adjacent up-slope roofing element upon installation on a roof. The roofing element has a first relief feature formed therein. The first relief feature has a first surface portion and a second surface portion. The first and second surface portions meeting along a common vertex, the first surface portion is closer to the fastener securement than the second surface portion. The first surface portion defines a flank surface of the relief feature, the flank surface having a gentle overall rise-over-run in the length direction. The second surface portion defines an end face surface of the relief feature, the end face surface portion having a steep rise-over-run in the length direction.

In another way to express an aspect of the invention, as described above, there is a four-sided formed roofing tile. It may be made of folded sheet metal. The top edge is over-folded upward. The bottom edge is under-folded downward, such that next adjacent top and bottom edges are mutually engageable. Similarly the side edges include one side, a first side, that is upfolded and another side, a second side, that is down-folded such that the folded side edges of adjacent tiles (or plates or elements, however they may be called) are mutually engaging. The arrangement may be left-handed or right-handed. The top edge has two top corners. The first top corner is where the top edge meets the up-folded side edge. The second top corner is at the other end of the top edge, i.e., where the top edge meets the down-folded side edge. An accommodation is formed at the first corner. The accommodation may have the form of a bulge, such as a bulge in the top flange, and a recession, or receded portion, in the up-folded side flange adjacent to the corner. A cuff is formed at the second corner. The cuff is sized to fit in the accommodation, such that the cuff of one roofing element seats in the accommodation of the next adjacent roofing element when an array of such elements is installed.

The roofing element may then have such combination of the individual elements and features described above as may be appropriate. The principles of the present invention are not limited to these specific examples, which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details, but only as according to a purposive interpretation of the appended claims.

I claim:

1. A roofing element for mounting on a sloped roof, the roof having a slope-wise direction, a cross-wise direction transverse to the slope-wise direction, and an upstanding direction normal to the sloped roof, said roofing element comprising:

a formed sheet metal panel having a cross-slope width and a slope-wise length;

said sheet metal panel having a top edge margin, a bottom edge margin, a first side edge margin, and a second side edge margin, said top edge margin being for installation up-slope of said bottom edge margin when mounted to the sloped roof;

said top edge margin having an upwardly formed over-folded flange with a distal flange edge oriented down-slope;

said bottom edge having a downwardly formed under-folded flange with a distal flange edge oriented up-slope;

said bottom edge having a down-slope margin defining a drip line, as installed in use said drip line lying down slope of a mating top edge margin of a next lower adjacent roofing element;

said first side edge margin having an upwardly bent over-folded first side flange;

said second side edge margin having a downwardly bent under-folded second side flange;

said top edge margin and said first side edge margin meeting at a first corner;

said top edge margin and said second side edge margin meeting at a second corner;

said top edge margin having a first top edge corner portion at said first corner;

said top edge margin having a second top edge corner portion at said second corner;

said first side edge margin having a first top corner portion at said first corner;

said second side edge margin having a second top corner portion at said second corner;

said first top edge corner portion having an enlarged accommodation formed therein;

said second top edge corner portion having a cuff fitting formed thereat;

said cuff fitting being sized to mate, on installation, with a corresponding enlarged accommodation of a next laterally adjacent roofing element, the corresponding enlarged accommodation being the same as said enlarged accommodation of said first top edge corner portion.

2. The roofing element of claim 1 wherein said cuff fitting includes a double folded cuff.

3. The roofing element of claim 2 wherein said double folded cuff includes an outer cuff and an inner cuff nested within said outer cuff, as oriented on installation, said outer cuff opening toward the next laterally adjacent roofing member.

4. The roofing element of claim 2 wherein said double folded cuff is of a size to fit in an interference fit in said enlarged accommodation.

5. The roofing element of claim 2 wherein said double folded cuff includes an outer cuff and an inner cuff nested within said outer cuff, and said outer cuff has a margin extending laterally beyond said inner cuff.

6. The roofing element of claim 5 wherein said outer cuff is flared.

7. The roofing element of claim 1 wherein said first top corner portion of said first side edge margin is formed to cooperate with said first top edge corner portion of said top edge margin to define a narrowing end portion that, when installed lies concealed beneath the second top edge corner portion of the top edge margin of the next laterally adjacent roofing member.

8. The roofing element of claim 7 wherein said narrowing portion has an upstanding closed end.

9. The roofing element of claim 7 wherein said first side edge margin first top corner portion includes an upstanding flange formed on a curve toward said first corner, said curve having an increasing downslope angle tangent in a direction along said curve away from said corner.

10. The roofing element of claim 1 wherein:

said cuff fitting includes a double folded cuff;

said double folded cuff includes an outer cuff and an inner cuff nested within said outer cuff, as oriented on installation, said outer cuff opening toward the next laterally adjacent roofing member;

said outer cuff has a margin extending laterally beyond said inner cuff;

said first top corner portion of said first side edge margin is formed to cooperate with said first corner portion of said first top edge margin to define a narrowing end portion that, when installed lies concealed beneath the second top edge corner portion of the top edge margin of the next laterally adjacent roofing member; and said narrowing portion has an upstanding closed end.

11. A roofing element for mounting on a sloped roof, the sloped roof having a slope-wise direction, a cross-wise direction transverse to the slope-wise direction, and an upstanding direction normal to the sloped roof, said roofing element comprising:

a four-sided formed sheet metal panel having a cross-slope width and a slope-wise length;

said sheet metal panel having a top edge margin, a bottom edge margin, a first side edge margin, and a second side edge margin, said top edge margin being for installation up-slope of said bottom edge margin when mounted to the sloped roof;

said top edge margin having an upwardly formed over-folded flange with a distal flange edge oriented down-slope;

said bottom edge having a downwardly formed under-folded flange with a distal flange edge oriented up-slope;

said bottom edge having a down-slope margin for overlapping a next lower adjacent roofing element;

said first side edge margin having an upwardly bent over-folded first side flange;

said second side edge margin having a downwardly bent under-folded second side flange;

said top edge margin and said first side edge margin meeting at a first corner;

said top edge margin and said second side edge margin meeting at a second corner;

said first corner being formed to have an accommodation formed therein;

said second corner being formed into a cuff fitting;

said cuff fitting being sized to fit in said accommodation, such that in an array of said roofing elements the cuff fitting of one said roofing element is seatable in the accommodation of a next laterally adjacent roofing element.

12. The roofing element of claim 11 wherein said cuff fitting includes a double folded cuff.

13. The roofing element of claim 12 wherein said double folded cuff includes an outer cuff and an inner cuff nested within said outer cuff, as oriented on installation, said outer cuff opening toward the next laterally adjacent roofing member.

14. The roofing element of claim 12 wherein said double folded cuff is of a size to fit in an interference fit in said enlarged accommodation.

15. The roofing element of claim 12 wherein said double folded cuff includes an outer cuff and an inner cuff nested within said outer cuff, and said outer cuff has a margin extending laterally beyond said inner cuff.

16. The roofing element of claim 15 wherein said outer cuff is flared.

17. The roofing element of claim 11 wherein said first corner is formed to cooperate with said top edge margin to define a narrowing end portion that, when installed lies concealed beneath the second corner of the top edge margin of the next laterally adjacent roofing member.

18. The roofing element of claim 11 wherein said first side edge margin first top corner includes an upstanding flange formed on a curve toward said first top corner, said curve having an increasing downslope angle tangent in a direction along said curve away from said first top corner.

19. The roofing element of claim 11 wherein:

said cuff fitting includes a double folded cuff;

said double folded cuff includes an outer cuff and an inner cuff nested within said outer cuff, as oriented on installation, said outer cuff opening toward the next laterally adjacent roofing member;

said outer cuff has a margin extending laterally beyond said inner cuff;

said first top corner portion of said first side edge margin is formed to cooperate with said first corner portion of said first top edge margin to define a narrowing end portion that, when installed lies concealed beneath the second top edge corner portion of the top edge margin of the next laterally adjacent roofing member; and said narrowing portion has an upstanding closed end.

20. The roofing element of claim 11 wherein said roofing element has at least one cleat extending upslope from said top edge margin.

21. The roofing element of claim 11 wherein said roofing element has at least one cleat extending in a cross-slope direction from one of said first and second side edge margins.

22. The roofing element of claim 11 wherein:

said first and second side edge margins run in the lengthwise direction;

said first and second end margins run in the cross-wise direction;

said first and second side margins and first and second end margins co-operating to define a rectangular footprint extending in a plane;

said first end margin has a first fastening region;

said first side margin has a second fastening region;

said second end margin has a skirt for placement overlapping a lengthwise next adjacent roofing element;

said second side margin includes a skirt for placement overlapping a cross-wise next adjacent roofing element.

* * * * *